US006948512B2

(12) United States Patent
McKeague

(10) Patent No.: US 6,948,512 B2
(45) Date of Patent: Sep. 27, 2005

(54) FLUSHING ATTACHMENT FOR HYDRANT

(75) Inventor: Daniel G. McKeague, Kirkwood, MO (US)

(73) Assignee: John C. Kupferle Foundry Co., St. Louis, MO (US)

( * ) Notice: Subject to any disclaimer, the term of this patent is extended or adjusted under 35 U.S.C. 154(b) by 0 days.

(21) Appl. No.: 10/993,243

(22) Filed: Nov. 19, 2004

(65) Prior Publication Data

US 2005/0067015 A1 Mar. 31, 2005

Related U.S. Application Data

(63) Continuation of application No. 10/656,572, filed on Sep. 5, 2003, now Pat. No. 6,820,635.

(51) Int. Cl.[7] ..... B08B 3/04; B08B 9/032; E03B 9/04

(52) U.S. Cl. ..... 137/15.05; 137/299; 137/296; 137/238; 137/382; 137/624.12; 137/614.13; 134/168 C; 134/22.11; 134/22.12

(58) Field of Search ..... 137/238, 296, 137/15.05, 624.12, 624.13, 299, 272, 377, 382, 383; 134/168 C, 22.11, 22.12

(56) References Cited

U.S. PATENT DOCUMENTS

| | | | | |
|---|---|---|---|---|
| 1,086,841 | A | 2/1914 | Mueller | |
| 3,980,096 | A | 9/1976 | Ellis et al. | |
| 4,154,259 | A | 5/1979 | Ellis et al. | |
| 4,165,532 | A | 8/1979 | Kendall et al. | |
| 4,189,776 | A | 2/1980 | Kendall | |
| 4,393,891 | A | 7/1983 | Snoek et al. | |
| 4,556,080 | A | 12/1985 | Picaud | |
| 4,756,479 | A | 7/1988 | Lazenby, III | |
| 4,799,142 | A | 1/1989 | Waltzer et al. | |
| 5,201,338 | A | 4/1993 | McKeague | |
| 5,549,133 | A | 8/1996 | Sigelakis | |
| 5,746,923 | A | 5/1998 | Forward | |
| 5,797,417 | A | 8/1998 | DeLattre et al. | |
| 5,885,364 | A | 3/1999 | Hieatt et al. | |
| 5,915,395 | A | 6/1999 | Smith | |
| 5,921,270 | A | 7/1999 | McCarty | |
| 5,979,482 | A | 11/1999 | Scott | |
| 5,996,608 | A | 12/1999 | Hunter et al. | |
| 6,035,704 | A | 3/2000 | Newman | |
| 6,056,211 | A | 5/2000 | DiLoreto | |
| 6,062,259 | A | 5/2000 | Poirier | |
| 6,095,429 | A | 8/2000 | Killgrove et al. | |
| 6,116,525 | A | 9/2000 | Grimes | |
| 6,170,514 | B1 | 1/2001 | Esmailzadeh | |
| 6,227,463 | B1 | 5/2001 | Porter | |
| 6,358,408 | B1 | 3/2002 | Newman | |
| 6,467,498 | B1 | 10/2002 | Esmailzadeh | |
| 6,635,172 | B2 | 10/2003 | Newman | |
| 6,820,635 | B1 * | 11/2004 | McKeague | 137/299 |
| 6,880,566 | B2 | 4/2005 | Newman | |

OTHER PUBLICATIONS

The Kupferle Foundry Company, Model 77 flushing hydrant (2003) (1 page).

The Toro Company, Form No 490–2991 (Oct. 1999) (3 pages).

The Toro Company, Form No. 490–3008 (May 2000) (1 page).

* cited by examiner

*Primary Examiner*—Kevin Lee
(74) *Attorney, Agent, or Firm*—Polster, Lieder, Woodruff & Lucchesi

(57) ABSTRACT

A device and method for automatically flushing hydrants. The device is installed externally to an existing hydrant. The device comprises a nipple having an internally threaded collar for attaching the device to a hydrant outlet, a valve, a control for automatically operating the valve, and a lockable box containing at least the valve, the box having an outlet for allowing water from the hydrant to pass from the valve to the exterior of the box. The box functions as an enclosure and may be of any desired configuration.

16 Claims, 3 Drawing Sheets

FLUSHING ATTACHMENT FOR HYDRANT

CROSS-REFERENCE TO RELATED APPLICATIONS

This is a continuation of application Ser. No. 10/656,572, filed Sep. 5, 2003, now U.S. Pat No. 6,820,635, the contents of which are incorporated by reference.

STATEMENT REGARDING FEDERALLY SPONSORED RESEARCH

Not Applicable.

BACKGROUND OF THE INVENTION

This invention relates to hydrants attached to municipal water systems, and in particular to a device for simplifying the flushing of portions of water systems by hydrants attached in the system.

The need for periodically flushing portions of water systems, particularly dead-ends in the systems, has been recognized for many years, as shown for example in Lazenby III, U.S. Pat. No. 4,756,479. A summary of many of the problems requiring such flushing, as well as of the traditional solutions to those problems, is contained in my co-owned U.S. Pat. No. 5,201,338. More recently, such flushing operations have been automated, as described in McCarty, U.S. Pat. No. 5,921,270. The McCarty patent is owned by a company related to the assignee of the present invention. A similar approach is described in Newman, U.S. Pat. Nos. 6,035,704 and 6,358,408. Other approaches are shown in Poirer, U.S. Pat. No. 6,062,259, and Esmailzadeh, U.S. Pat. No. 6,467,498.

Although the prior art systems have met with some success, the complexity of the systems, the time and effort required to install and use them, and their consequent expense have limited their use.

BRIEF SUMMARY OF THE INVENTION

Briefly stated, the present invention provides a device and method for automatically flushing hydrants. The device is installed externally to an existing hydrant. The device comprises a nipple having an internally threaded collar for attaching the device to a hydrant outlet, a valve, and a control for automatically operating the valve. Preferably, the device includes a lockable box containing at least the valve, the box having an outlet for allowing water from the hydrant to pass from the valve to the exterior of the box. The box functions as an enclosure and may be of any desired configuration.

In accordance with an embodiment of the invention, the collar is rotatably mounted to the nipple externally of the box. In accordance with an embodiment of the invention, the control is mounted internally of the box. In an embodiment of the invention, the box includes a perforate lower wall through which water escapes. In other embodiments, a hose or pipe extends through a wall of the box to expel water; in some of those embodiments, the hose or pipe is connected to the valve in a closed system. The device is preferably supplied with a carrying handle for ease of transport and attachment to a hydrant.

Although the system of the present invention is not freeze-proof, it has been found that contrary to conventional wisdom, this is not a serious drawback. In many geographic areas, having particular problems with stagnant water, freezing is not generally a problem. Moreover, in temperate climates, the most severe problems with stagnant water generally occur in warm seasons. Further, because the device of the present invention is easily removable and portable, it can be brought to a site requiring its use on short notice and when temperature conditions are mild enough not to interfere with its use.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
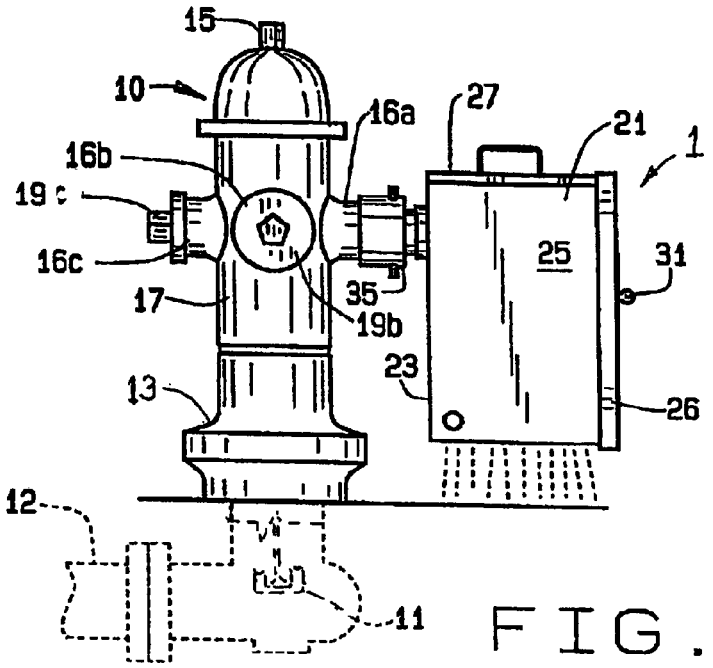
FIG. 1 is a somewhat diagrammatic view in side elevation, showing a device of the present invention attached to a hydrant and flushing a water system through the hydrant.
Figure 2:
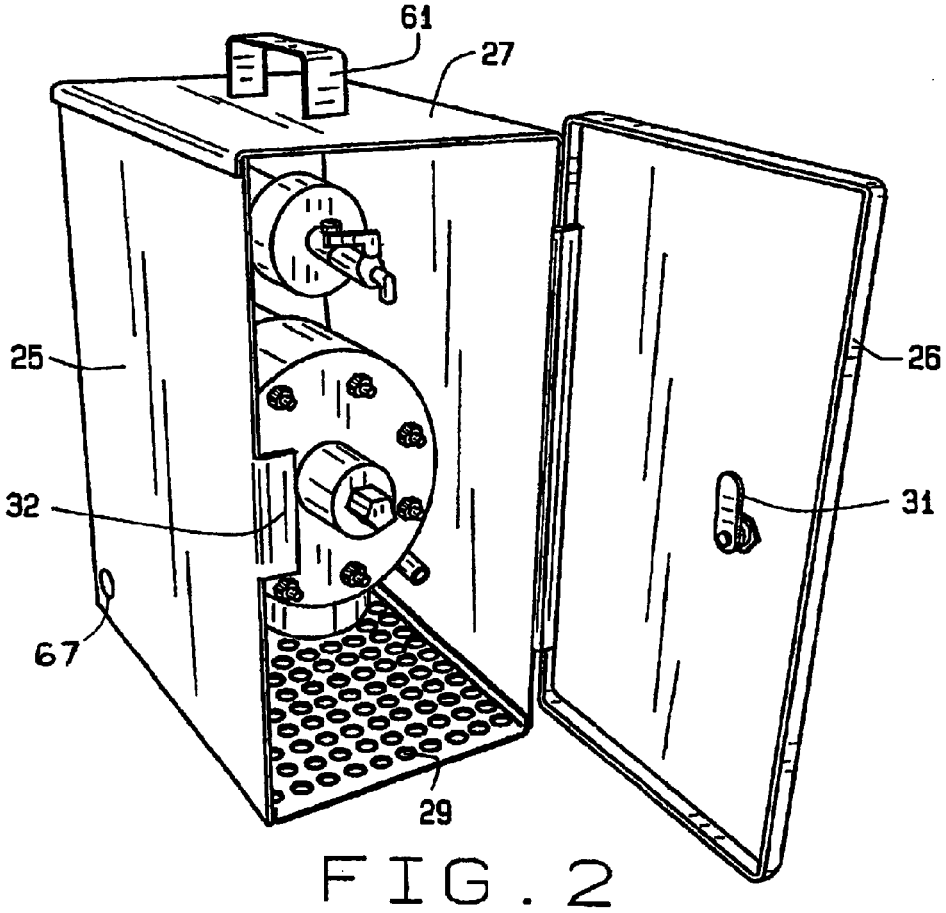
FIG. 2 is a view in perspective of the device of FIG. 1, with a door of a box of the device opened to show the interior of the device.

As shown in FIG. 1, an illustrative embodiment of the invention includes an automatic flushing device 1 attached to one outlet of a hydrant 10.

The hydrant 10 is illustratively a so-called dry barrel hydrant, having a valve 11 below ground, generally below the local frost line, connecting the hydrant to a municipal water distribution system indicated generally at 12. The valve 11 is self-draining, so that, when it is closed, water drains from the cast body 13 of the hydrant 10. The valve 11 is opened and closed manually by attaching a wrench to a pentagonal head 15 extending from the top of the hydrant 10. When the valve 11 is opened, the hydrant 10 fills with water. Three externally threaded outlets 16*a–c* threaded into the vertical wall 17 of the hydrant 10 are capped with caps 19*a–c* (the cap 19*a* being removed and not shown). The caps 19*a–c* are individually manually removable, using a wrench. The outlets, illustratively and conventionally, include two 2.5" NST outlets 16*a* and 16*c* and one 4" NST outlet 16*b*. This construction is typical of a conventional fire hydrant, described for example in Ellis et al., U.S. Pat. Nos. 3,980,096 and 4,154,259.

The illustrative device 1 of the present invention is designed to be mounted to one of the 2.5" NST outlets of the hydrant 1.

The device 1 includes a box 21 made of sheet aluminum and having a rear wall 23, sides 25, a front door 26 hinged to one of the sides 25, a top 27, and a bottom 29. The front door 26 is supplied with a keyed lock 31 to hold the door shut by engaging an angle 32 welded to the sidewall.

Figure 3:
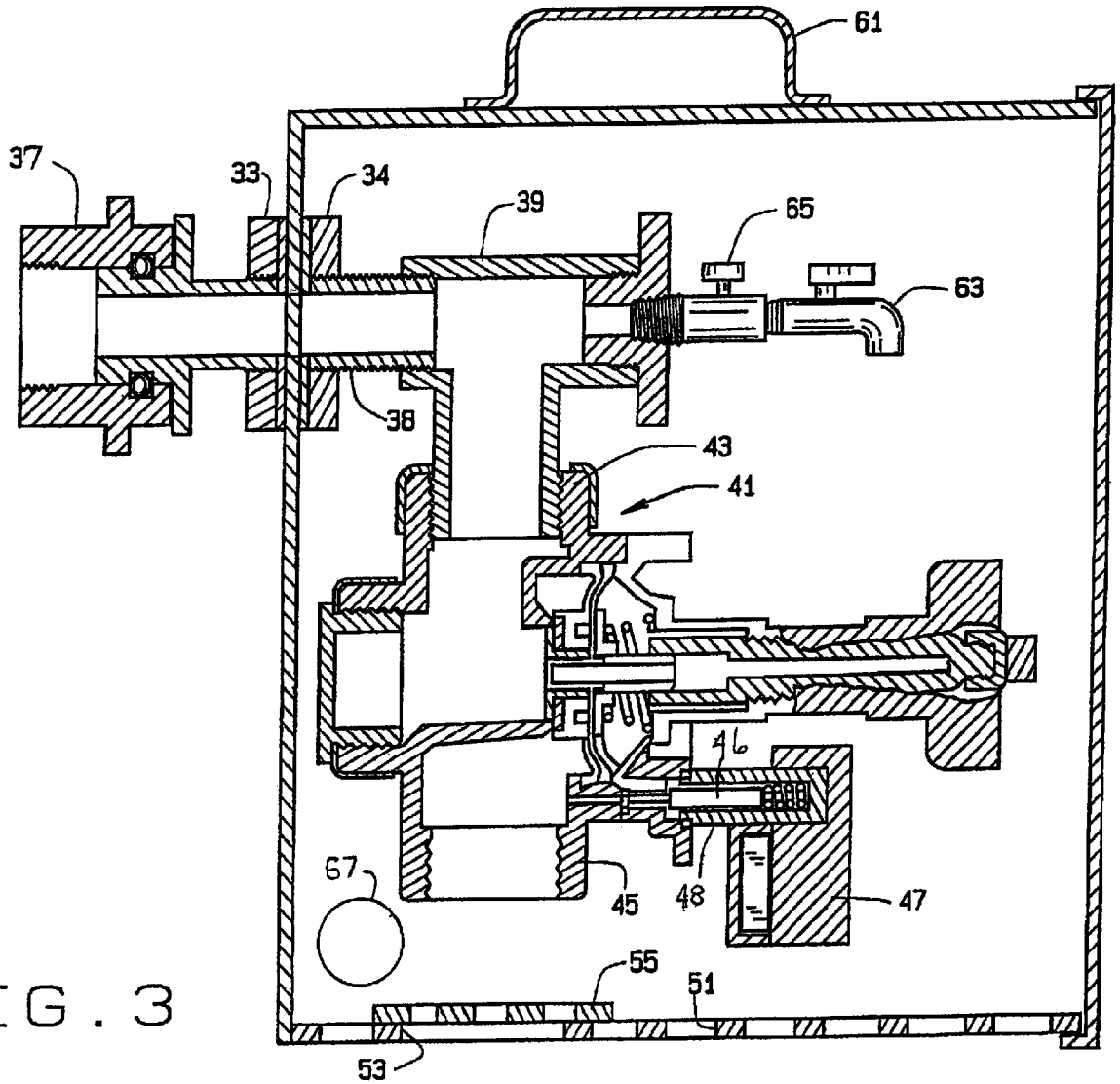
FIG. 3 is a longitudinal cross-section of the device of FIGS. 1 and 2.

As shown in FIG. 3, at the upper portion of the rear wall 23, two identical flanges 33 and 34 are bolted to the inside and outside of the wall, respectively, by bolts, not shown, extending through openings in the rear wall 23 and connecting the flanges 33 and 34. The outside flange 33 supports a 2.5" NST×2" male iron pipe swivel 35. The swivel 35 includes a lugged collar 37 designed to form a water-tight fit when threaded onto a 2.5" NST externally threaded outlet of the hydrant 10. This type of coupling is well known in the art and is described, for example, in Porter, U.S. Pat. No. 6,227,463.

Inside the box 21, the flange 34 forms a fluid connection between the swivel 35 and a pipe 38 having external 2" iron pipe threads. The pipe 38 is connected by a tee 39 to an inlet of an electrically-operated valve 41. The valve 41 is illustratively a 2" Model P-220 plastic irrigation valve sold by The Toro Company. The valve 41 is a diaphragm valve in which line pressure exerted over the diaphragm holds the valve closed, and opening of a bleed port by a solenoid relieves pressure in the diaphragm chamber and causes the valve to open. The construction of the P-220 valve is described in Toro Form No 490-2991 (October 1999) incorporated by reference herein. The construction and operation of such valves are well known in the art and are described for example in Hunter et al., U.S. Pat. No. 5,996,608 and Scott, U.S. Pat. No. 5,979,482. The valve 41 is oriented with its inlet 43 up and its outlet 45 directed down. The valve 41 is manually adjustable to permit flow rates from a trickle to in excess of two-hundred-fifty gallons per minute.

The solenoid plunger 46 of valve 41 is controlled by a Toro Remote 1000 Series battery-operated valve controller 47. The controller 47 is described in Toro Form No. 490-3008 (May 2000). The controller 47 includes a housing having a socket sized to fit over the casing 48 of plunger 46. Within the housing, the socket is surrounded by a coil connected to a battery and programmable circuitry for activating the coil to operate the solenoid. The Remote 1000 Series controller is described in U.S. Pat. No. 5,797,417, issued to DeLattre et al. As set out in this patent, the illustrative control is a removable, bistable, programmable actuator for a solenoid. The controller 47 is battery powered and includes manually operable buttons for setting the operating cycle to twice per day, once per day, once per two days, and once per week, for setting the run time from six seconds to almost twenty-four hours, and for setting the beginning of the run time for zero hours, four hours, eight hours, or twelve hours after programming is completed. The controller 47 may be removed from the valve 41 for programming.

Figure 4:
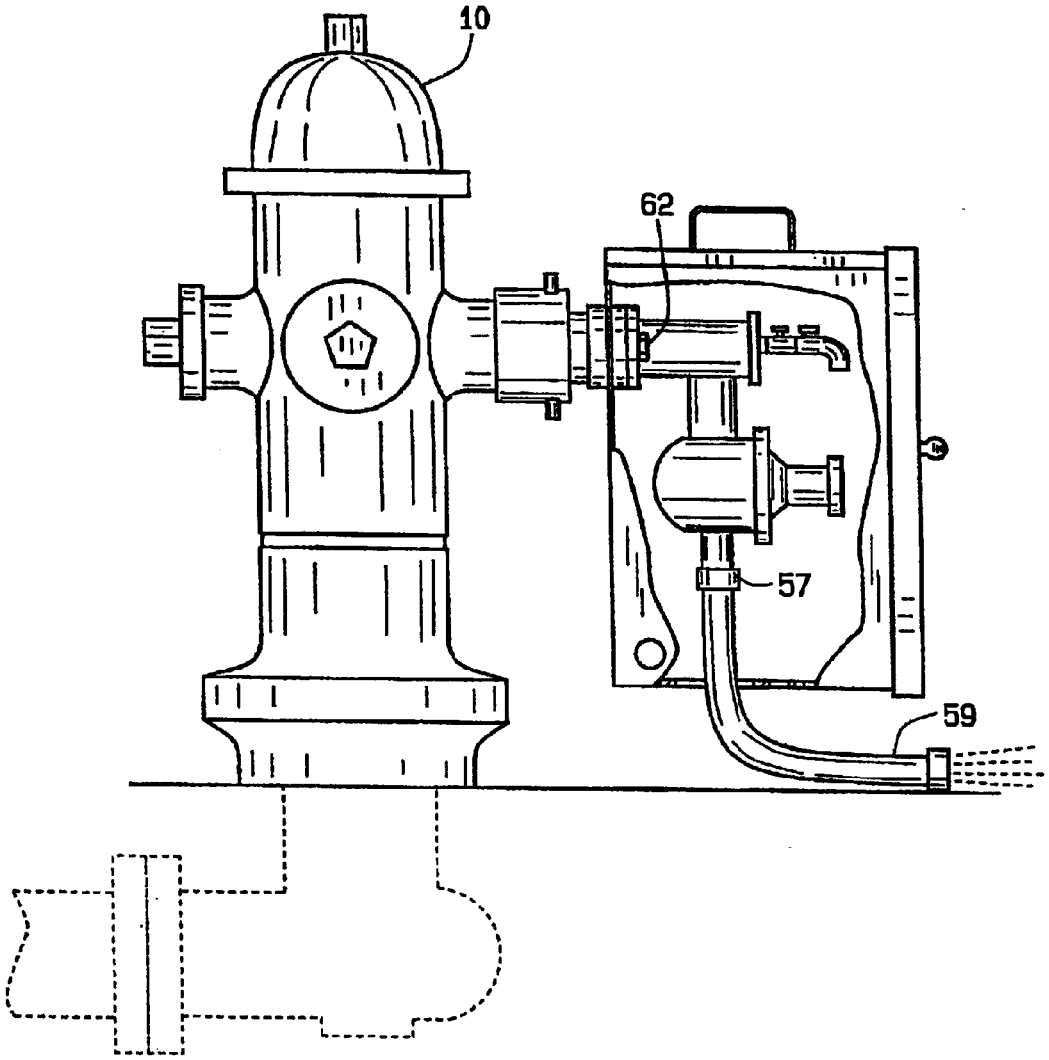
FIG. 4 is a view corresponding to FIG. 1, showing a discharge hose attached to the device.

The lower wall 29 of the box 21 is formed with 0.5" perforations 51 to diffuse water emanating from the outlet 45 of the valve 41 inside the box 21. A cut-out 53 directly under the outlet 45 permits installation of a diffuser plate 55, or alternatively of a pipe nipple extending from the outlet 45 through the lower wall 29, as shown in FIG. 4. When used, the nipple 57 is preferably threaded to receive a hose 59 or diffuser to distribute water expelled through the device 1 to a desired remote location.

The upper wall 27 of the box 21 is provided with a strap handle 61 for carrying the device 1 and for positioning it while installing it on a hydrant.

The device 1 is assembled by threading the swivel 35 into the external flange 33, threading the tee 39 into the inlet of the valve 41, threading the internal flange 33 onto the inlet end of the tee 39, applying gaskets to the flanges 33, and bolting the flanges 33 together through the rear wall 23 of the box as indicated at 62 in FIG. 4. This assembly method allows the box to be nearly the same width and depth as the valve 41. The controller 47 may be pre-installed on the valve 41 or not as desired. Because the controller may be programmed before it is installed on the valve, it is frequently more convenient to program one or more controllers at a central location, for later installation on devices 1.

The free end of the tee 39 is provided with a sampling bibb 63 for periodically manually taking samples of water to be tested. A ball valve shut-off 65 protects the bibb from leaking.

The use of the device 1 is simple. The device 1 is carried to a hydrant 10, and the cap of a 2.5" NST outlet of the hydrant is manually removed. The device 1 is then held in position with the handle 61 while the collar 37 is threaded onto the outlet. The device 1 is thereafter held above the ground by the swivel 35 and flange 33. The controller 47 is programmed to a desired start and stop time, and to a desired cycle time. The door 26 is unlocked and opened, the controller 47 is placed on the electrically controlled valve, and the door is closed and locked. The pentagonal head 15 of the manual valve 11 is turned to open the valve 11. The device 1 will thereafter open the valve 41 at a desired time for a desired interval in accordance with a desired cycle (twice daily, daily, bi-daily, or weekly) to flush the system. If desired, a chain may be passed through chain holes 67 and locked around the hydrant 10.

When the device 1 has done its job, or when it is needed at another location, the hydrant 10 is manually closed by closing the manual valve 11, the device 1 is unthreaded from the hydrant 10, the cap is replaced on the hydrant, and the device 1 is moved to another location. When prolonged freezing temperatures are expected, the hydrant 10 is shut off (and drains automatically) and the device 1 is removed until weather conditions permit its reuse.

As various changes could be made in the above constructions without departing from the scope of the invention, it is intended that all matter contained in the above description or shown in the accompanying drawings shall be interpreted as illustrative and not in a limiting sense.

Merely by way of illustration, because the device operates substantially independent of the construction of the hydrant (other than requiring an outlet to which it can be attached), the device may be installed to hydrants other than the illustrative dry barrel fire hydrant 10. For example it can be attached to a flushing hydrant such as the one described in Lazenby III, U.S. Pat. No. 4,756,479, or else to a wet barrel type of hydrant. It is presently being sold by The Kupferle Foundry Company with its Model 77 flushing hydrant. The swivel 35 may be externally threaded, for example if the external outlet 16 is removed from the hydrant body.

A feed chemical such as dechlorination tablets may be placed in the water path, as for example by placing them on the bottom wall 29 of the box.

Whether the flushed water is diffused through the perforated lower wall 29 or is carried away by a pipe or hose 59, various types of splash guards or other water control devices may be utilized, including for example those shown in DiLoreto, U.S. Pat. No. 6,056,211 or Grimes, U.S. Pat. No. 6,116,525. Flushed water may also be routed to a sewer line, drain field, or storm drain.

Instead of a T, a street L may connect the valve 41 to the swivel 35, if a sampling valve is not required.

The swivel 35 may be a tamper-proof design, or the swivel 35 may be positioned inside the box 21 if a separate support in the box is provided for the valve 41, although this may make attachment of the device to a hydrant less convenient. Numerous tamperproof designs such as the one shown in Sigelakis, U.S. Pat. No. 5,549,133 are well known and may be utilized. When the device is used in circumstances where security is not a problem, the box 21 may be eliminated.

Other valves and other controls may be utilized, although the preferred solenoid valve and control are particularly simple. As set out in DeLattre et al, U.S. Pat. No. 5,797,417, the control may be powered in various ways, such as a rechargeable battery charged by solar or wind power, and may be controlled in various ways such as infra-red, telephone, or radio communication, either one-directional or bidirectional. As also set out in that patent, condition sensors rather than a timer may be used for controlling the operation of the device; it is therefore to be understood that the "periodic" operation of the valve need not occur on a strict timetable. More complex controls may also be used, as for example those described in Waltzer et al., U.S. Pat. No. 4,799,142, Kendall, U.S. Pat. No. 4,189,776, and Kendall et al., U.S. Pat. No. 4,165,532.

These variations are merely illustrative.

All of the patents and printed publications mentioned herein are incorporated herein by reference.

What is claimed is:

1. A portable, self-contained device for automatically flushing existing above-ground hydrants, the device being adapted to be removably installed to an outlet of an existing above-ground hydrant, the device comprising:

a valve for controlling flow from the hydrant through the valve;

a control for automatically operating the valve; and a lockable box containing at least one of the valve and the control, the box allowing water to pass from the hydrant into the box and allowing water from the valve to pass to the exterior of the box during a flushing operation.

2. The device of claim 1 wherein a hose or pipe extends through a wall of the box to expel water.

3. The device of claim 2 wherein the hose or pipe is physically connected to an outlet of the valve.

4. In combination, a hydrant, the hydrant having a below-ground inlet adapted to be connected to an underground water distribution system, an above-ground outlet, and a manually operable valve between the inlet and the outlet, and a device for automatically flushing the hydrant, the device comprising a wall having a swivel coupling secured thereto, the coupling being attached to the outlet of the hydrant; a valve for controlling flow from the hydrant through the valve, the valve being positioned on an opposite side of the wall from the hydrant; and a control for automatically operating the valve.

5. The device of claim 4 wherein the wall is a part of a box, the box enclosing the valve but not the hydrant.

6. The device of claim 5 wherein a hose or pipe extends through a wall of the box to expel water.

7. The device of claim 6 wherein the hose or pipe is physically connected to an outlet of the valve.

8. A method of automatically flushing a portion of a water distribution system, the system including a plurality of pre-existing hydrants, each hydrant having a below-ground inlet connected to the water distribution system, an above-ground outlet, and a manually operable valve between the inlet and the outlet, the method comprising bringing a portable, self-contained device to the hydrant; installing the device to the outlet of the hydrant, the device comprising an electrically operable valve and a control for periodically operating the electrically operable valve; opening the manually operable valve to allow water to flow through the hydrant into the device, thereafter allowing the control to open the electrically operable valve periodically to cause water to flow from the water distribution system through the hydrant and through the electrically operable valve to flush a portion of the water distribution system; and thereafter removing the device from the hydrant and installing the device to another of the plurality of hydrants.

9. The method of claim 8 wherein the control is mounted internally of a box, the method including programming the control to select at least one of time and duration of opening the valve in the box.

10. The method of claim 9 wherein the outlet of the hydrant is threaded, and wherein attaching the device to the hydrant comprises threading a threaded coupling to the outlet of the hydrant, the threaded coupling being rotatably mounted to the box.

11. The method of claim 10 wherein the coupling is a collar mounted to a nipple, externally of the box.

12. The method of claim 9 wherein the box includes a perforate lower wall, the perforate wall diffusing water expelled through it.

13. The method of claim 9 wherein the hydrant supports the box and holds it above the ground.

14. The method of claim 9 wherein a hose or pipe is provided, the hose or pipe carrying water from the valve to the exterior of the box.

15. The method of claim 8 wherein the hydrant is a fire hydrant.

16. The method of claim 8 wherein the hydrant is a flushing hydrant.

* * * * *